US006718915B1

(12) United States Patent
Albrecht et al.

(10) Patent No.: US 6,718,915 B1
(45) Date of Patent: Apr. 13, 2004

(54) HORIZONTAL SPIRAL TUBE BOILER CONVECTION PASS ENCLOSURE DESIGN

(75) Inventors: Melvin J. Albrecht, Knox Township, OH (US); J. William Smith, Massillon, OH (US)

(73) Assignee: The Babcock & Wilcox Company, New Orleans, LA (US)

( * ) Notice: Subject to any disclaimer, the term of this patent is extended or adjusted under 35 U.S.C. 154(b) by 0 days.

(21) Appl. No.: 10/320,342

(22) Filed: Dec. 16, 2002

(51) Int. Cl.[7] ..... F22B 37/20
(52) U.S. Cl. ..... 122/6 A; 122/235.23
(58) Field of Search ..... 122/6 A, 1 B, 122/406.4, 235.23, 235.33

(56) References Cited

U.S. PATENT DOCUMENTS

| | | | | |
|---|---|---|---|---|
| 1,543,273 A | | 6/1925 | Benson et al. | |
| 2,989,036 A | * | 6/1961 | Hake et al. | 122/235.23 |
| 3,105,466 A | | 10/1963 | Evans | |
| 4,175,519 A | | 11/1979 | Pratt et al. | |
| 4,182,274 A | | 1/1980 | Williams | |
| 4,524,727 A | | 6/1985 | Ammann | |
| 4,632,064 A | * | 12/1986 | Haneda et al. | 122/1 A |
| 4,987,862 A | * | 1/1991 | Wittchow et al. | 122/6 A |
| 5,094,191 A | | 3/1992 | Garkawe et al. | |
| 5,722,353 A | * | 3/1998 | Phelps | 122/6 A |
| 5,755,188 A | | 5/1998 | Phelps | |
| 5,934,227 A | | 8/1999 | Phelps | |
| 6,536,380 B1 | * | 3/2003 | Kral et al. | 122/406.4 |

FOREIGN PATENT DOCUMENTS

| | | |
|---|---|---|
| FR | 869635 | 2/1942 |
| GB | 201296 | 8/1923 |
| GB | 201304 | 8/1923 |
| GB | 206559 | 11/1923 |
| GB | 207874 | 12/1923 |
| SU | 802696 | 2/1981 |

* cited by examiner

*Primary Examiner*—Gregory A. Wilson
(74) *Attorney, Agent, or Firm*—Eric Marich; Kathryn W. Grant

(57) ABSTRACT

A convection pass enclosure for a boiler comprising a front wall having a gas inlet for receiving gases from the boiler; right and left side walls connected to the front wall; a rear wall having a gas outlet, the rear wall being connected between the right and left side walls; and a roof, at least one of the front wall, right side wall, left side wall and rear side wall having a heat exchanger surface in the form of a horizontal spiral tube assembly.

15 Claims, 18 Drawing Sheets

HORIZONTAL SPIRAL TUBE BOILER CONVECTION PASS ENCLOSURE DESIGN

FIELD AND BACKGROUND OF THE INVENTION

1. Field of the Invention

The present invention relates in general to boiler design, and in particular to a new and useful arrangement for the convection pass enclosure of a tube boiler.

2. Description of the Related Art

The design of convection pass enclosures for subcritical pressure drum and once-through boilers and supercritical pressure once-through boilers has consisted of vertical tube enclosure panels that are typically arranged to flow in either an upward or downward direction. The design requirements for these enclosures typically requires that a sufficient inside tube fluid velocity exist at all loads so that tube overheating, fatigue or failure is not encountered during the normal operating life of the boiler.

The two pass type of utility boilers has convection pass enclosures that are located adjacent the furnace enclosure. The pendant convection pass enclosure connects the furnace enclosure to the horizontal convection pass enclosure. The pendant convection pass enclosure is an enclosure that allows the furnace gases to flow from the furnace enclosure horizontally across pendant heat transfer surfaces (vertical arrangement of steam and/or water cooled tubes). The horizontal convection pass contains horizontally arranged heat transfer surface (steam and/or water cooled tubes) that absorbs heat from the furnace gases flowing in a downward direction in the enclosure.

In all two pass type utility boilers, the convection pass enclosure tubes must be designed to remove any stagnate water or steam legs that either exist during startup or that can form at any operating load of the boiler. In many cases multiple flow paths, small diameter orificing of the headers and/or the use of thick tubes with small inside diameters within the enclosure's circuitry are required to satisfy these requirements. For many boiler performance conditions, the heat transfer surface inside the convection pass enclosures requires an enclosure surface area that utilizes multiple flow paths. For these applications, the multiple flow paths will require a tube size and thickness that places a large pressure drop into the overall system design, which results in a penalty on unit efficiency. To obtain a realistic design, the large pressure drop of the enclosure must be reduced at the higher loads by using a flow bypass to reduce the velocity in the enclosure tubes at the higher loads.

The spiral tube furnace enclosure design was developed by Benson in 1927. This technology has been applied to furnace enclosure design for different reasons than those proposed in this disclosure for the horizontal spiral tube convection pass enclosure design. The concept for the prior furnace enclosures was to provide minimum temperature and enthalpy variation in the furnace enclosure while maintaining a flow velocity across the flow range that will eliminate tube failure resulting from critical heat flux. The concepts of the present invention differs from the Benson concept in that a reduction in the pressure drop of the fluid through the enclosure at higher loads is desired so that flow bypassing and/or thicker tubes and small orifices are not required.

Also see U.S. Pat. Nos. 5,934,227 and 5,755,188.

SUMMARY OF THE INVENTION

An object of the present invention is to use a spiral horizontal arrangement of tubes to eliminate the multiple flow passes, the small orifices and/or the thicker tubes of the prior art in a convection pass of a boiler. The spiral design allows flexibility of determining the number of tubes and the number of spiral loops around the enclosure to obtain the optimum velocity that will eliminate any stagnate legs of water or steam during startup and low load operation while still giving acceptable pressure drop at full load without the need for an enclosure bypass.

The concept has been used on three walls of the horizontal convection pass of a boiler. This concept could also be incorporated into both the horizontal and pendant convection passes of the boiler, if needed for performance improvements. The horizontal spiral tube of the invention in this embodiment starts on one of the side walls and encompasses any combination of exterior walls of the enclosure in the lower portion of the horizontal convection pass. If all four walls of the horizontal convection pass are used, the upper section of the horizontal convection pass would only encompass the side and rear walls of the enclosure.

The horizontal spiral tube boiler convection pass enclosure design of the present invention includes five advantages over the existing design.

1. An optimum tube size, tube thickness and the number of tubes for the convection pass enclosure can be determined so that excessive convection pass pressure drop and flow biasing around the convection enclosure is not required for some boiler loads.

2. Material weight of the convection pass enclosure can be reduced through the use of thinner tubes. The thinner tubes can be used to meet the design requirements of eliminating a stagnate leg of water or steam at start up and minimum load.

3. Performance efficiency penalties due to increased pressure drop of the enclosure design would be minimized by incorporating the concepts of this invention.

4. Manufacturing and construction costs of this invention would be slightly more than the current vertical tube design with a flow bypass system, but the performance advantages of the invention would make the addition cost attractive to the market.

5. This invention can be applied to both subcritical drum boilers as well as subcritical and supercritical once-through boilers.

Accordingly, a further object of the present invention is to provide a convection pass enclosure for a boiler comprising a front wall having a gas inlet for receiving gases from the boiler; right and left side walls connected to the front wall; a rear wall having a gas outlet, the rear wall being connected between the right and left side walls; and a roof, at least one of the front wall, right side wall, left side wall and rear side wall having a heat exchanger surface in the form of a horizontal spiral tube assembly.

A further object of the present invention is to provide more than one of the walls of the convection pass enclosure with horizontal spiral tube heat exchangers.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention is illustrated.

DESCRIPTION OF THE PREFERRED EMBODIMENT

Figure 1:
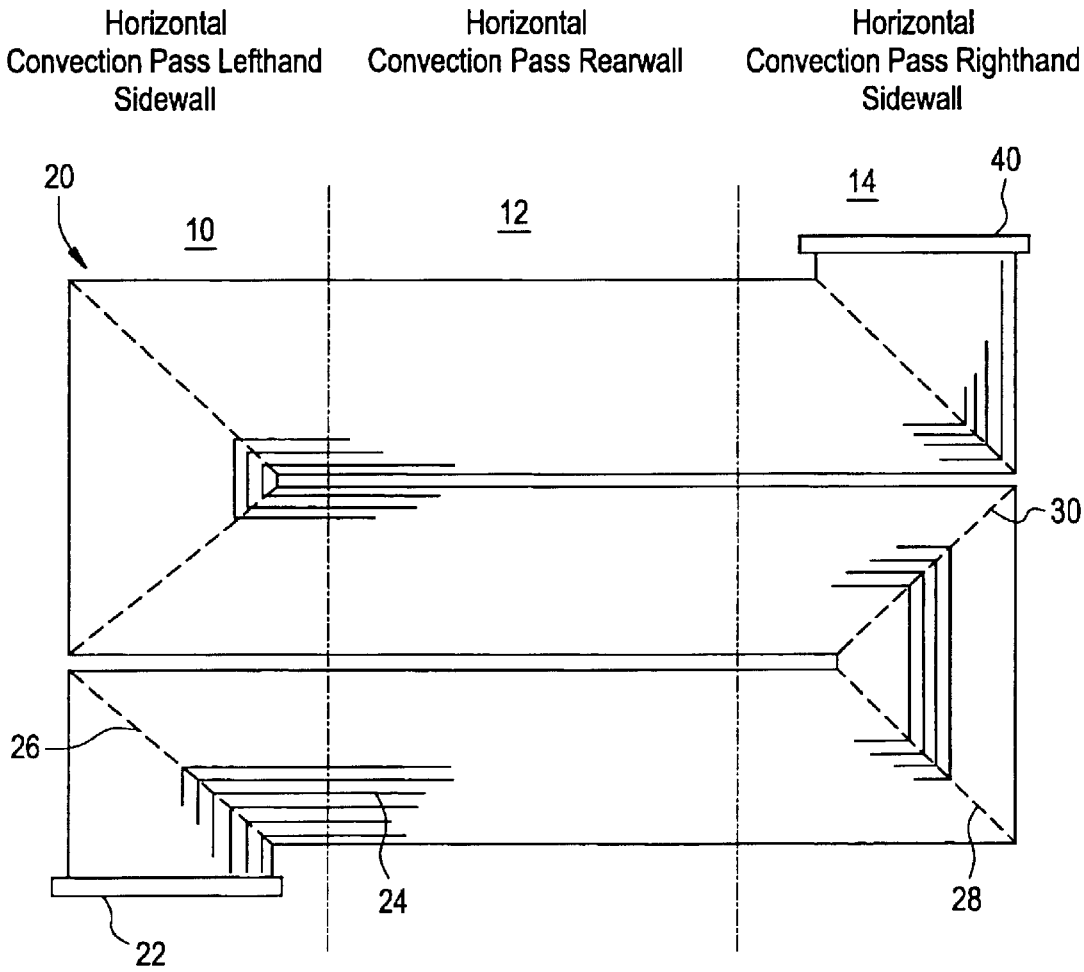
FIG. 1 is a schematic side expanded elevational view of the left, rear and right walls of a convection pass enclosure containing the horizontal spiral tube arrangement of the present invention.

Referring to the drawings generally, wherein like reference numerals designate the same or similar elements throughout the several drawings, the invention embodied in FIG. 1 comprises heat exchange surfaces for the convection pass enclosure of a boiler, the enclosure having schematically illustrated and expanded left-hand side wall area 10, rear wall 12 and right-hand side wall 14.

Each of the side walls and rear wall carry heat exchange surfaces in the form of a horizontal spiral tube arrangement designated 20 comprising an inlet header 22 for receiving a supply of cooling water and multiple tubes in a tube assembly 24 which are bent at about 45 degrees at a first bend plane 26, extend horizontally across part of the left side wall, all of the rear wall and some of the right side wall until the tube assembly meets a second bend plane 28 where the tubes and plate between the tubes bend upwardly until they reach a further bend plane 30 and then extend horizontally across the side walls and rear wall. This meandering path of horizontal runs connected by bends and vertical connections to the next run terminate at the upper header 40 where the water or water plus steam or superheated steam is discharged having picked up heat from the convection pass enclosure.

Figure 2:
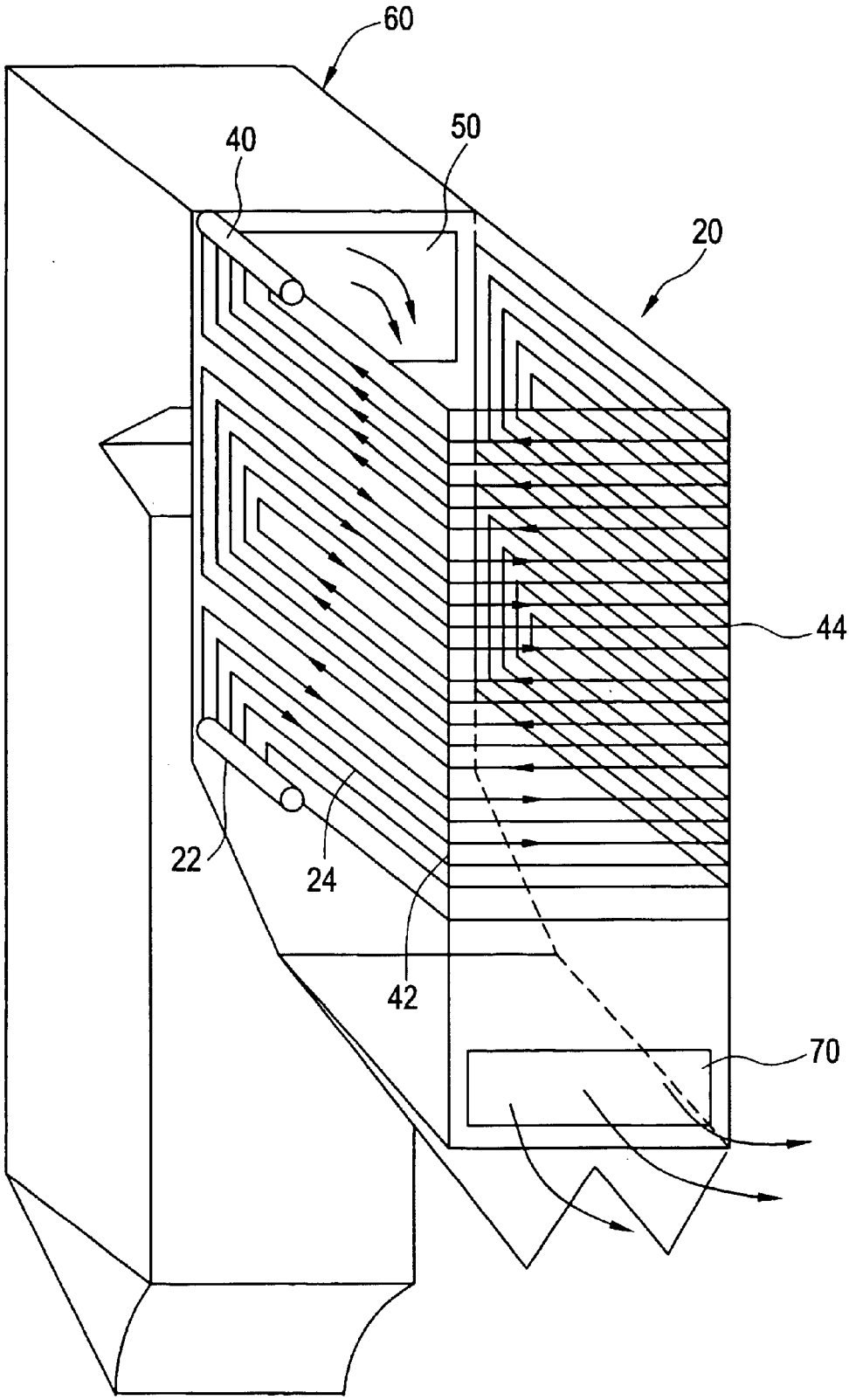
FIG. 2 is a schematic perspective view of another embodiment of the invention, and depicts a horizontal spiral tube arrangement lining the side walls and the rear wall of a convection pass enclosure.
Figure 3:
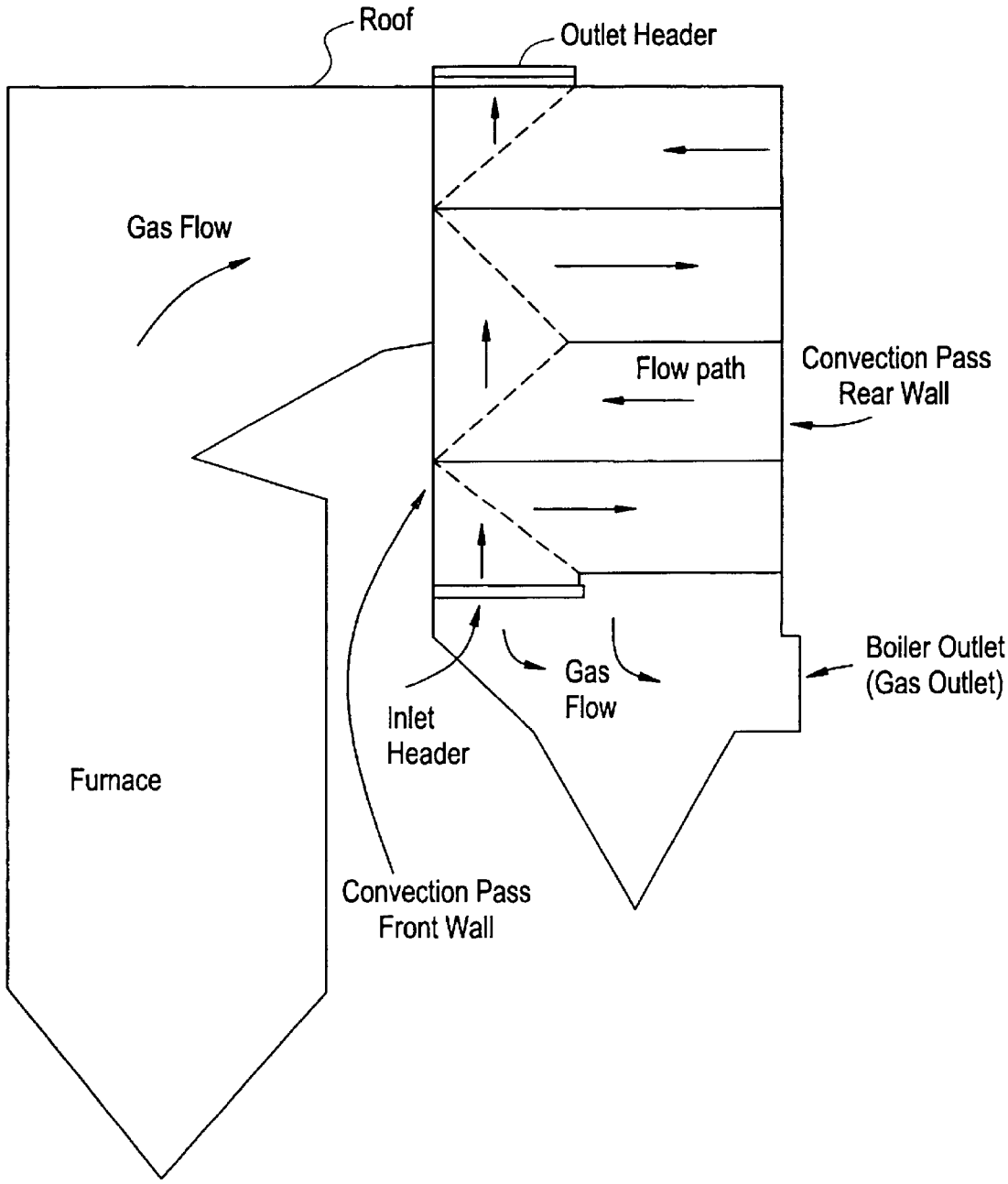
FIG. 3 is an elevational view of the right side wall of the embodiment of FIG. 2.
Figure 4:
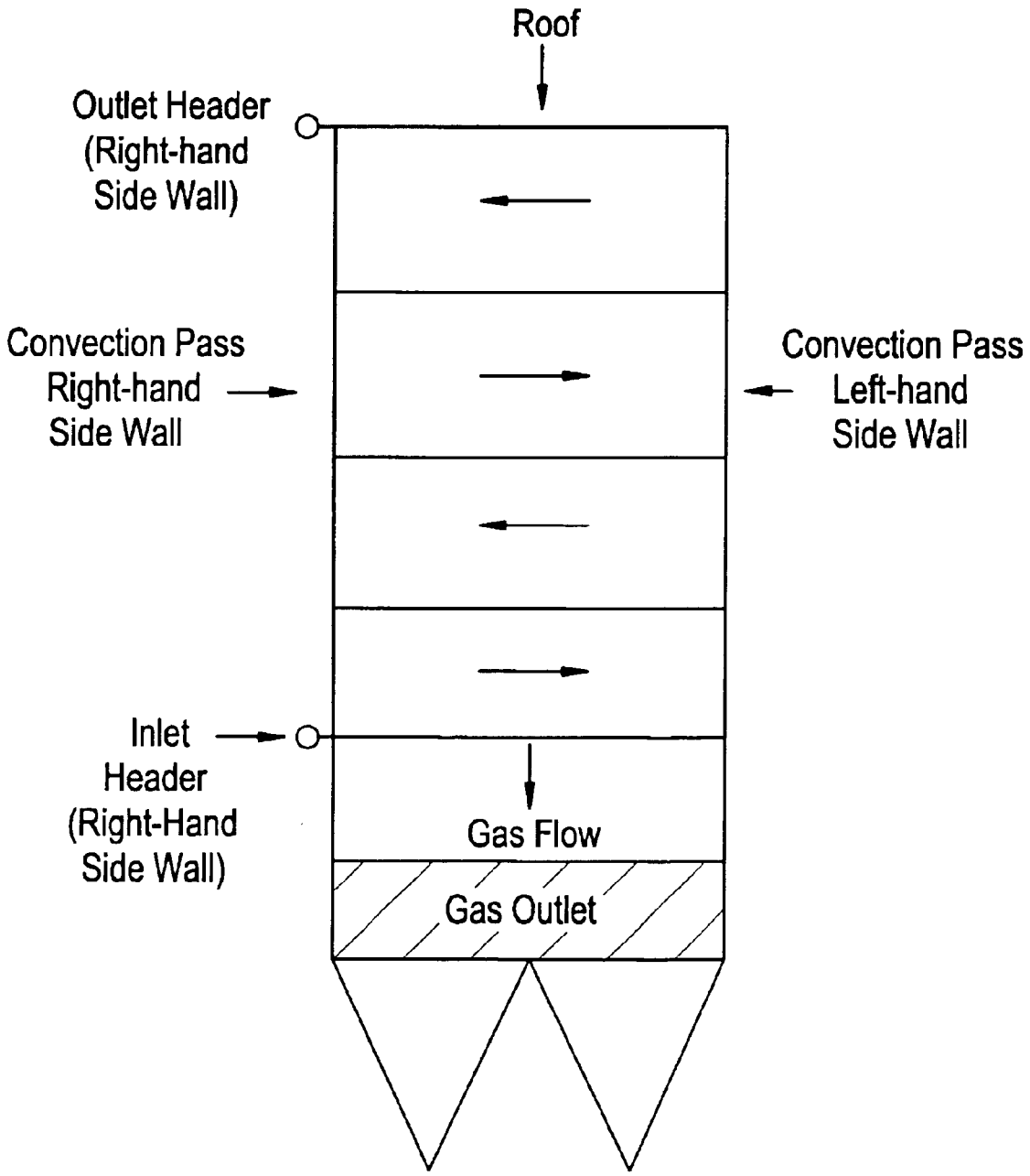
FIG. 4 is an elevational view of the rear wall of the embodiment of FIG. 2.
Figure 5:
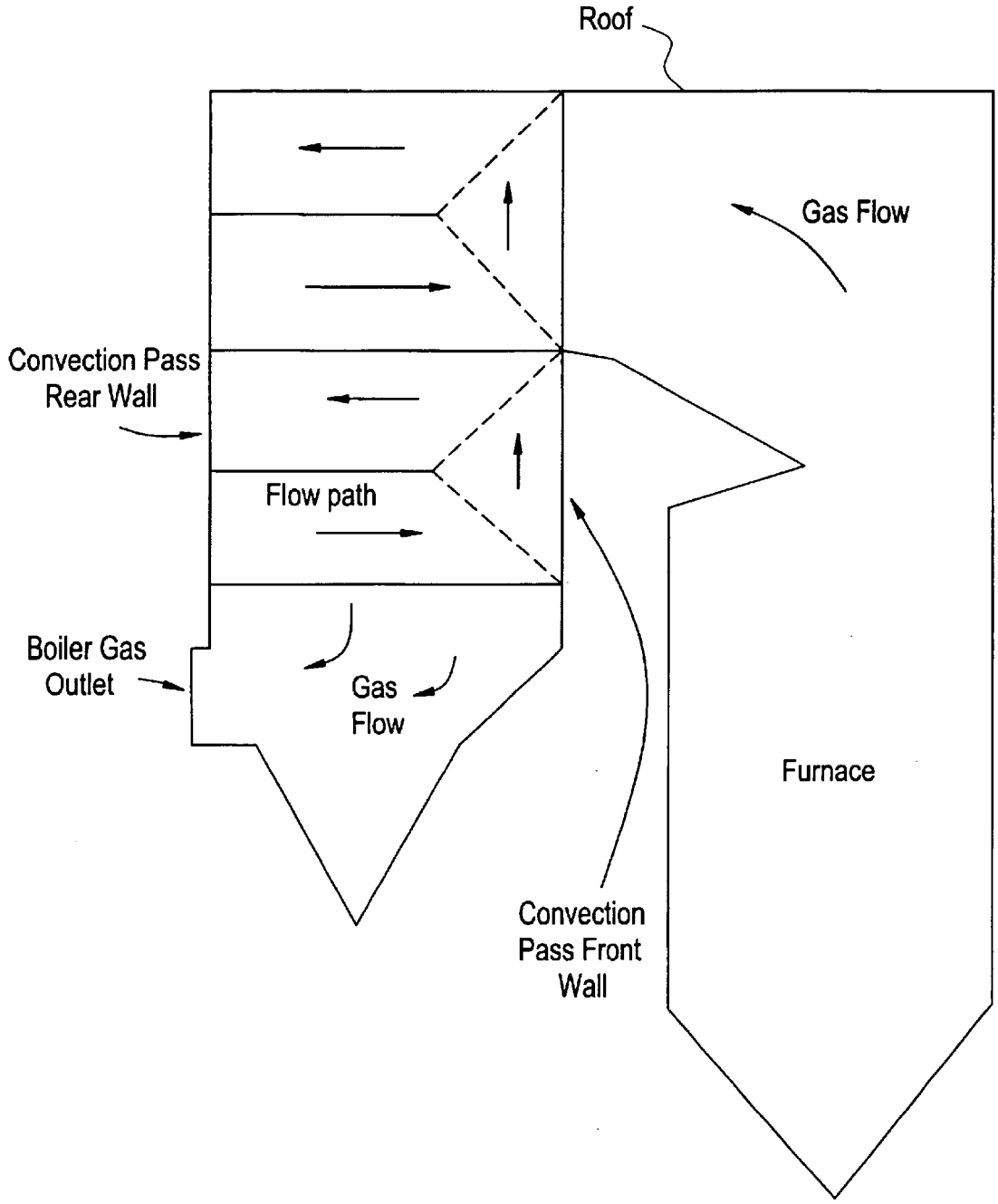
FIG. 5 is an elevational view of the left side wall of the embodiment of FIG. 2.
Figure 6:
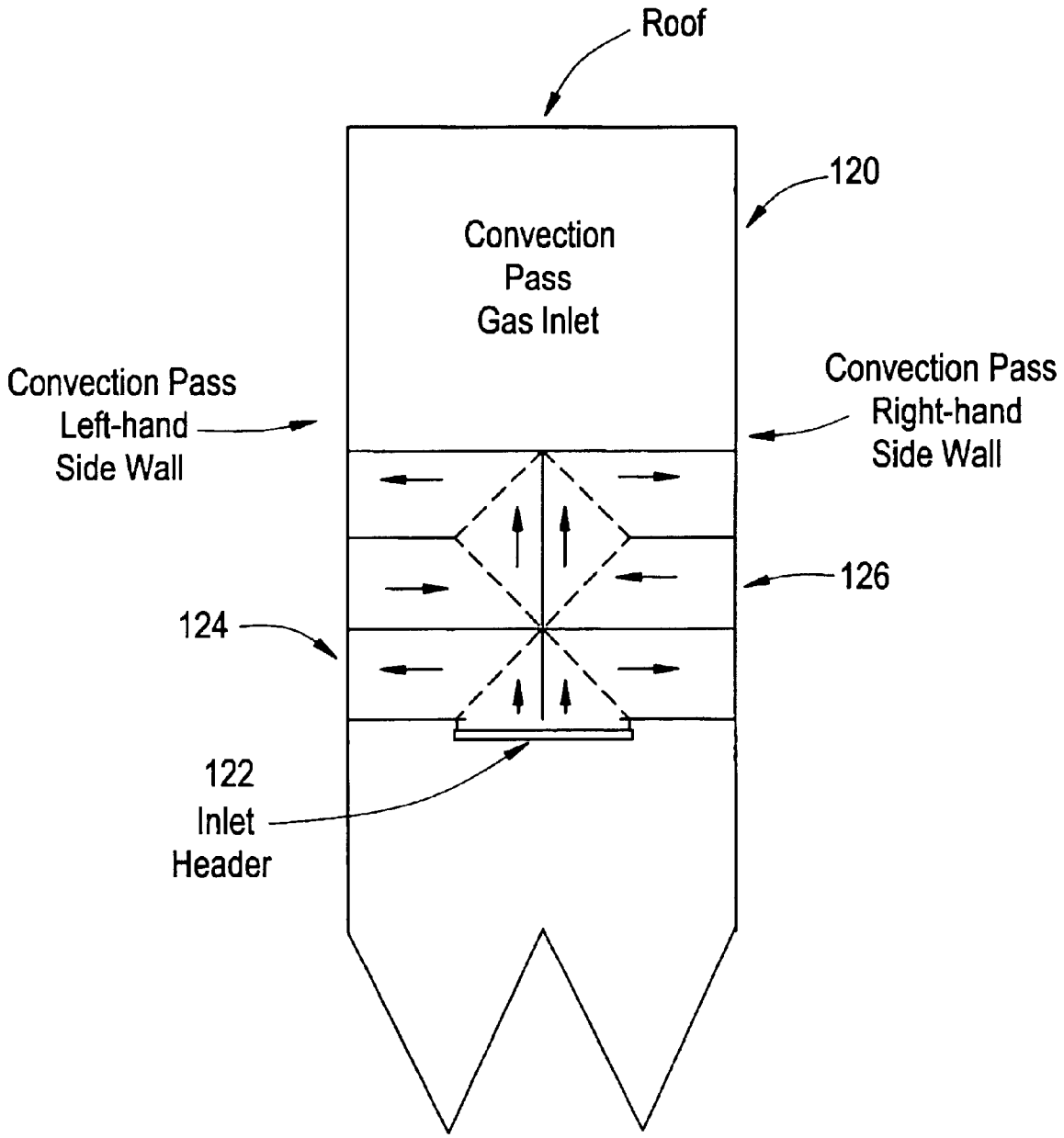
FIG. 6 is an elevational view of the front wall of another embodiment of the invention.
Figure 7:
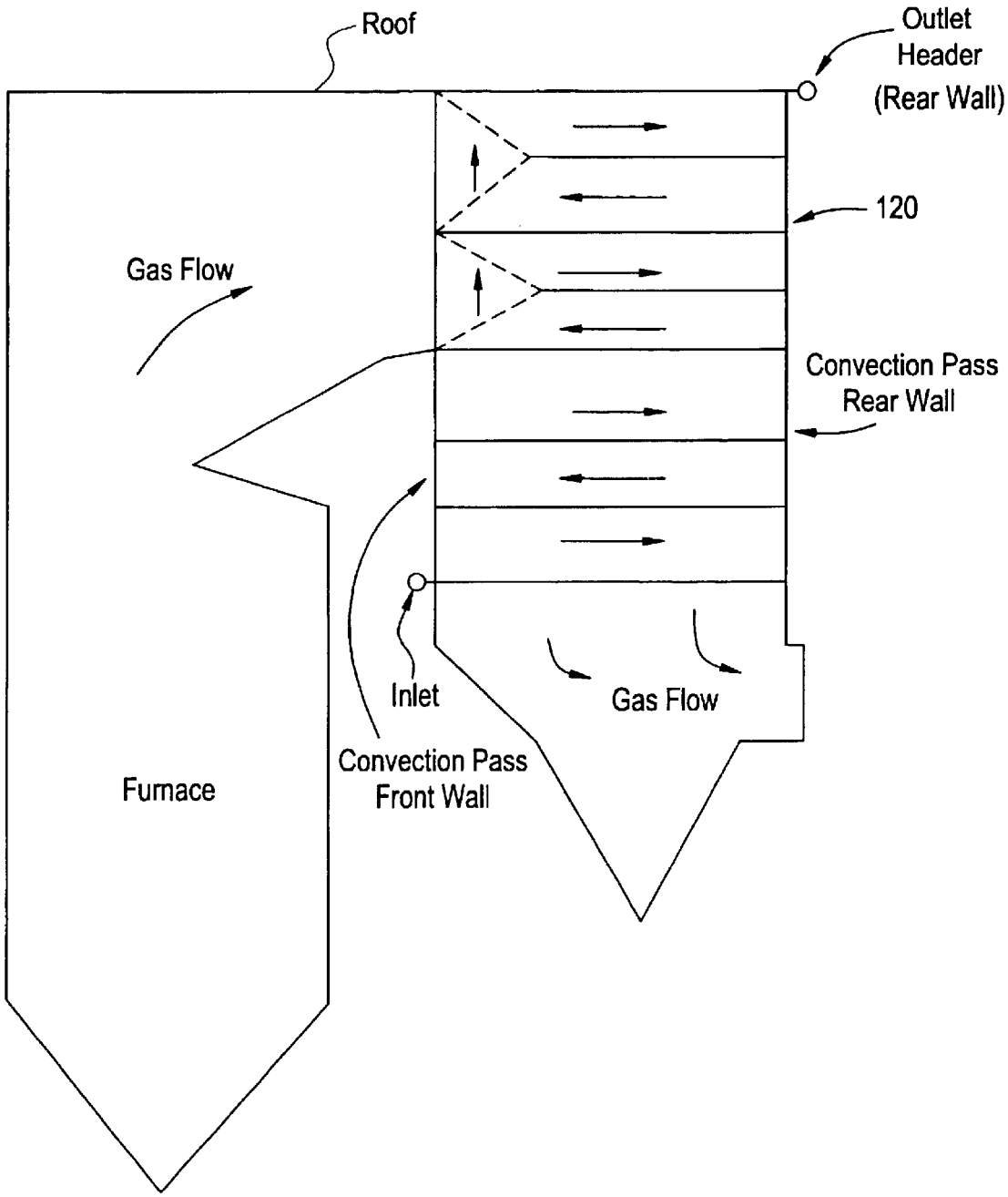
FIG. 7 is an elevational view of the right side wall of the embodiment of FIG. 6.
Figure 8:
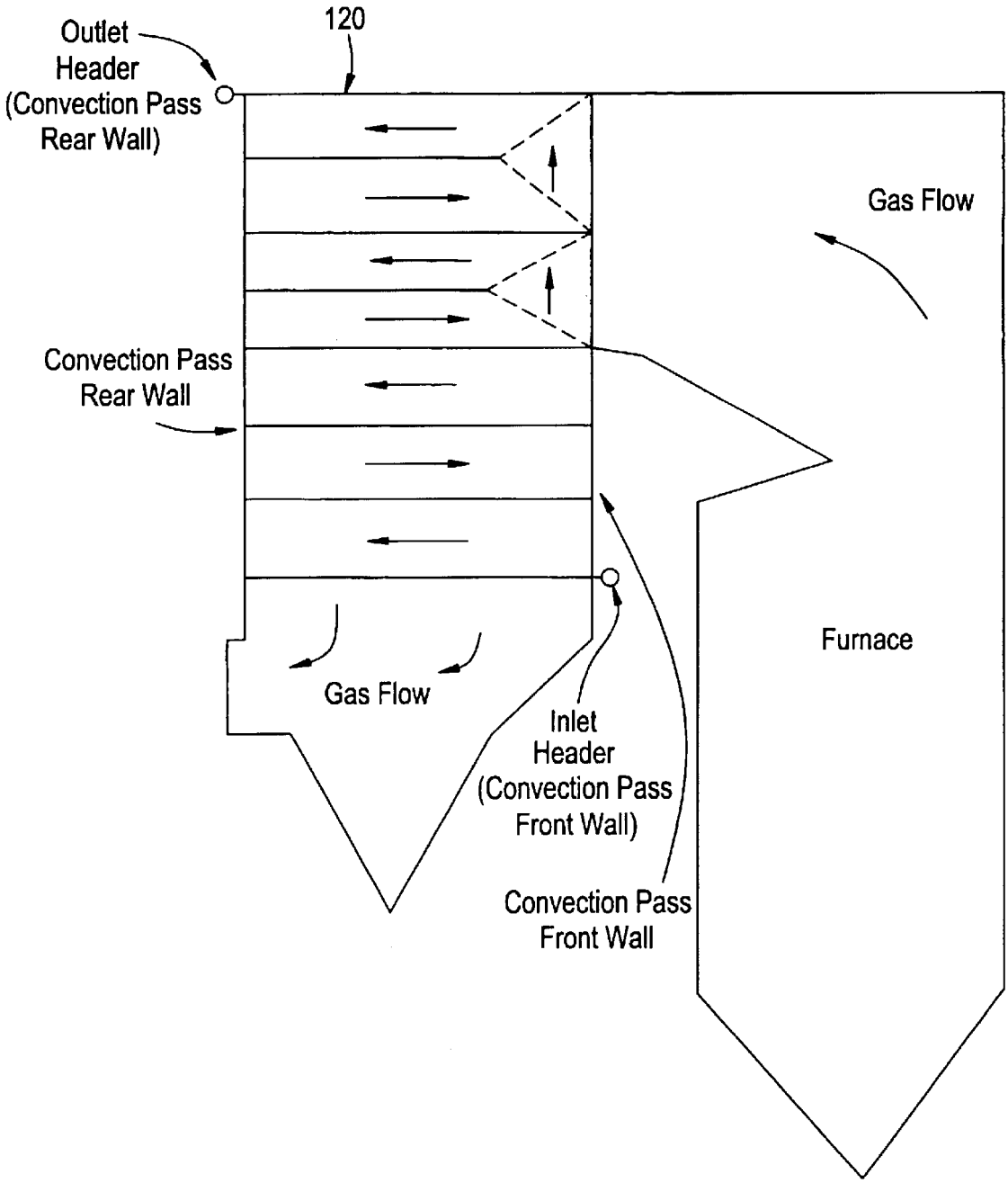
FIG. 8 is an elevational view of the left side wall of the embodiment of FIG. 6.
Figure 9:
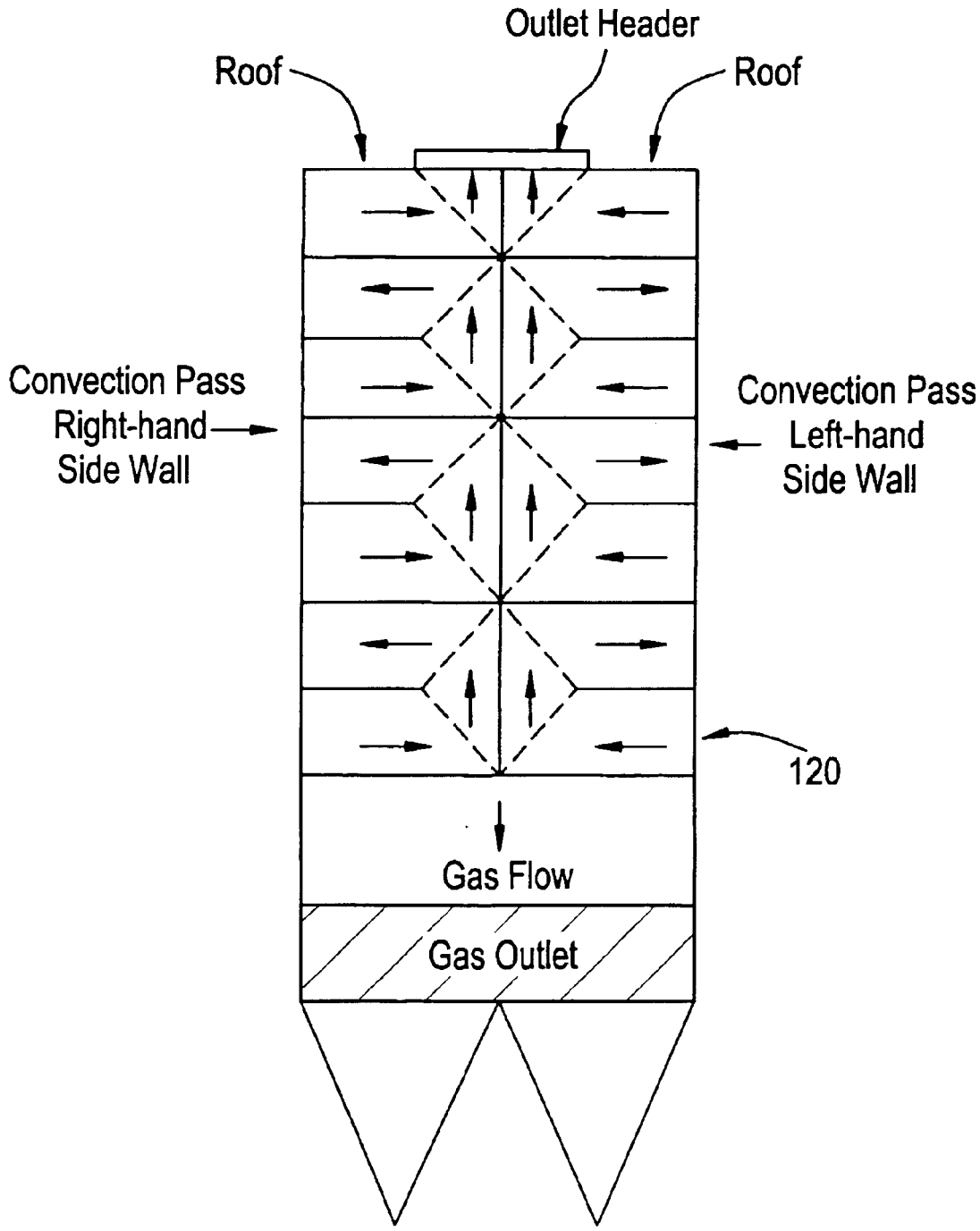
FIG. 9 is an elevational view of the rear wall of the embodiment of FIG. 6.
Figure 10:
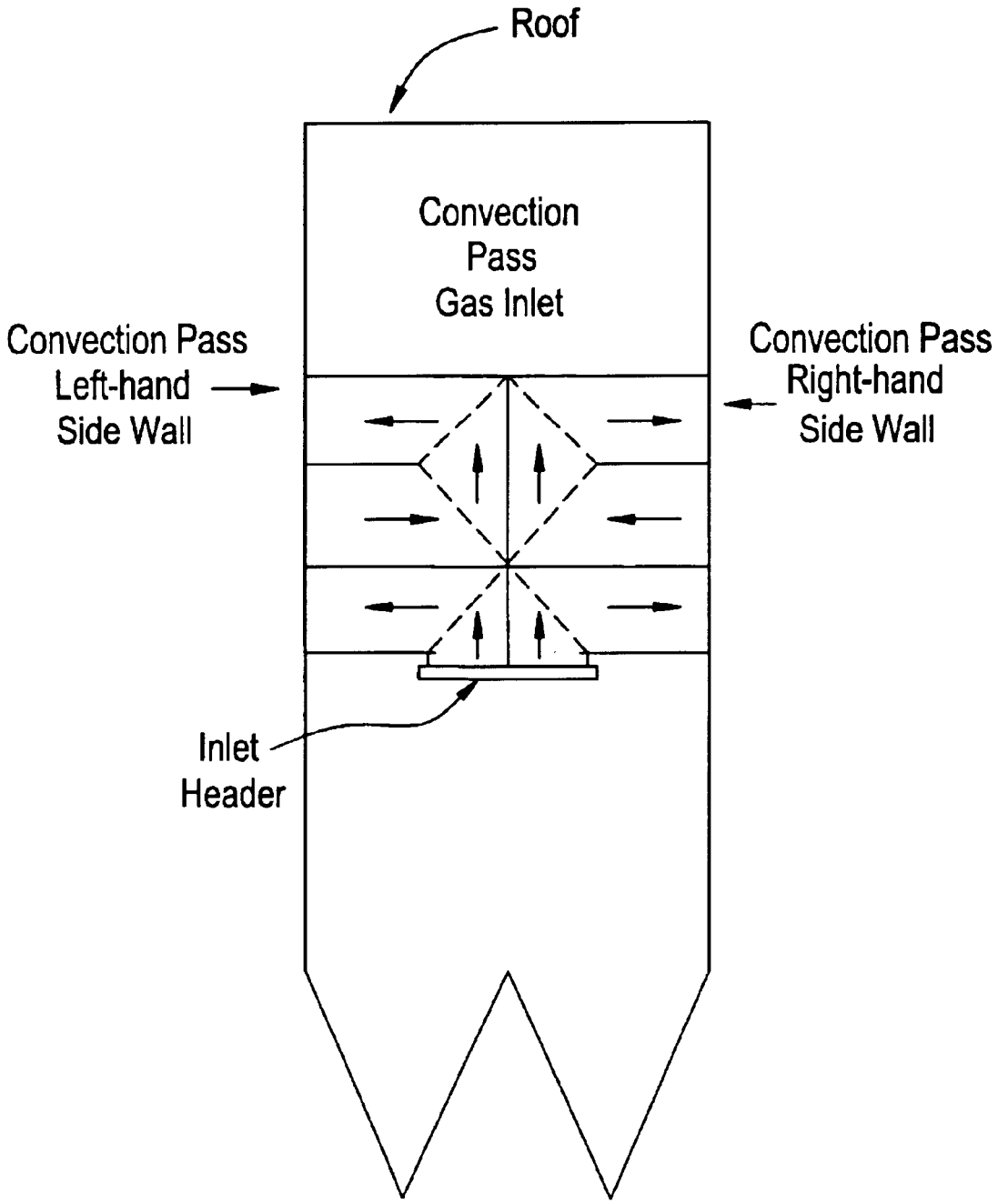
FIG. 10 is an elevational view of the front wall of a further embodiment of the invention.
Figure 11:
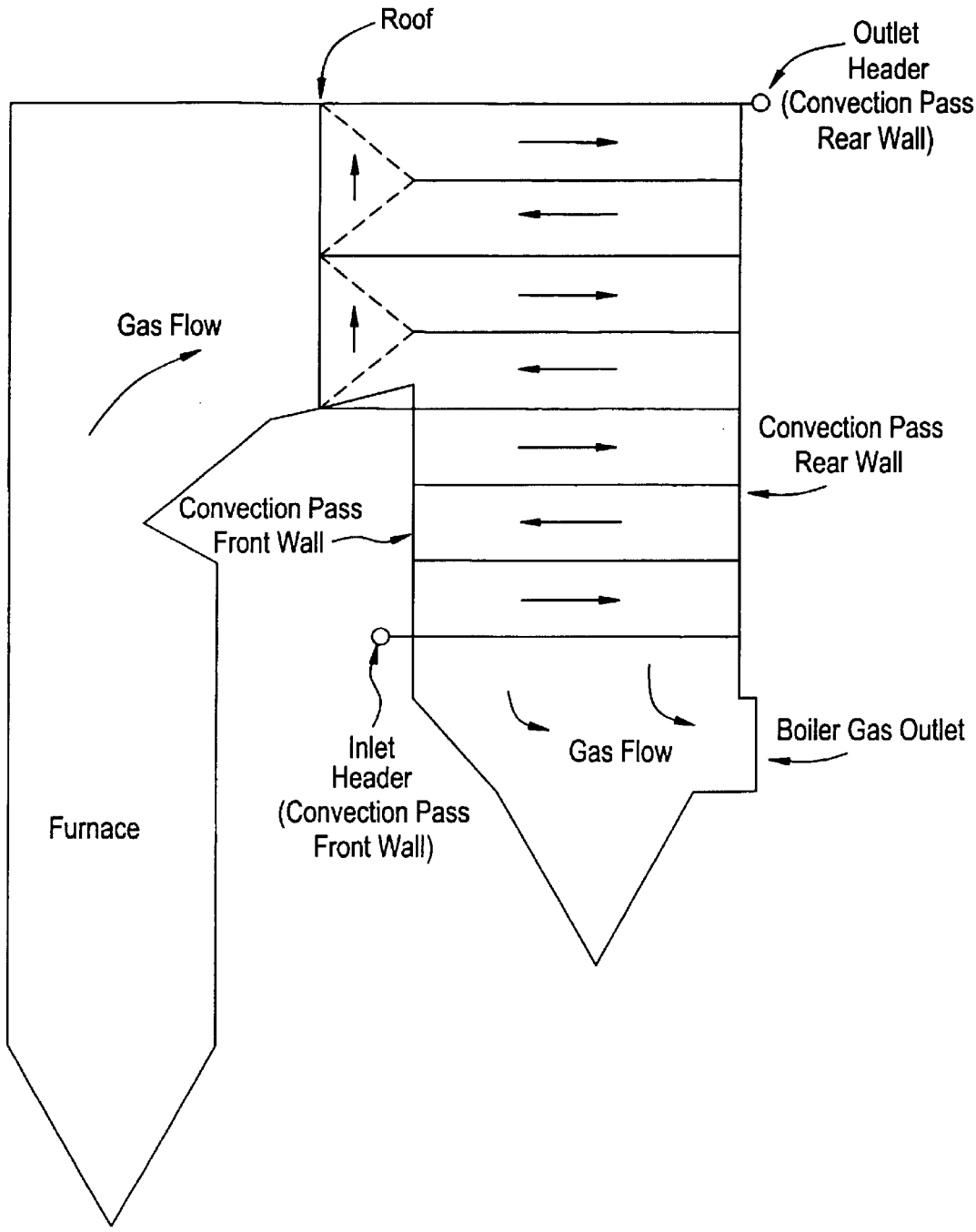
FIG. 11 is an elevational view of the right side wall of the embodiment of FIG. 10.
Figure 12:
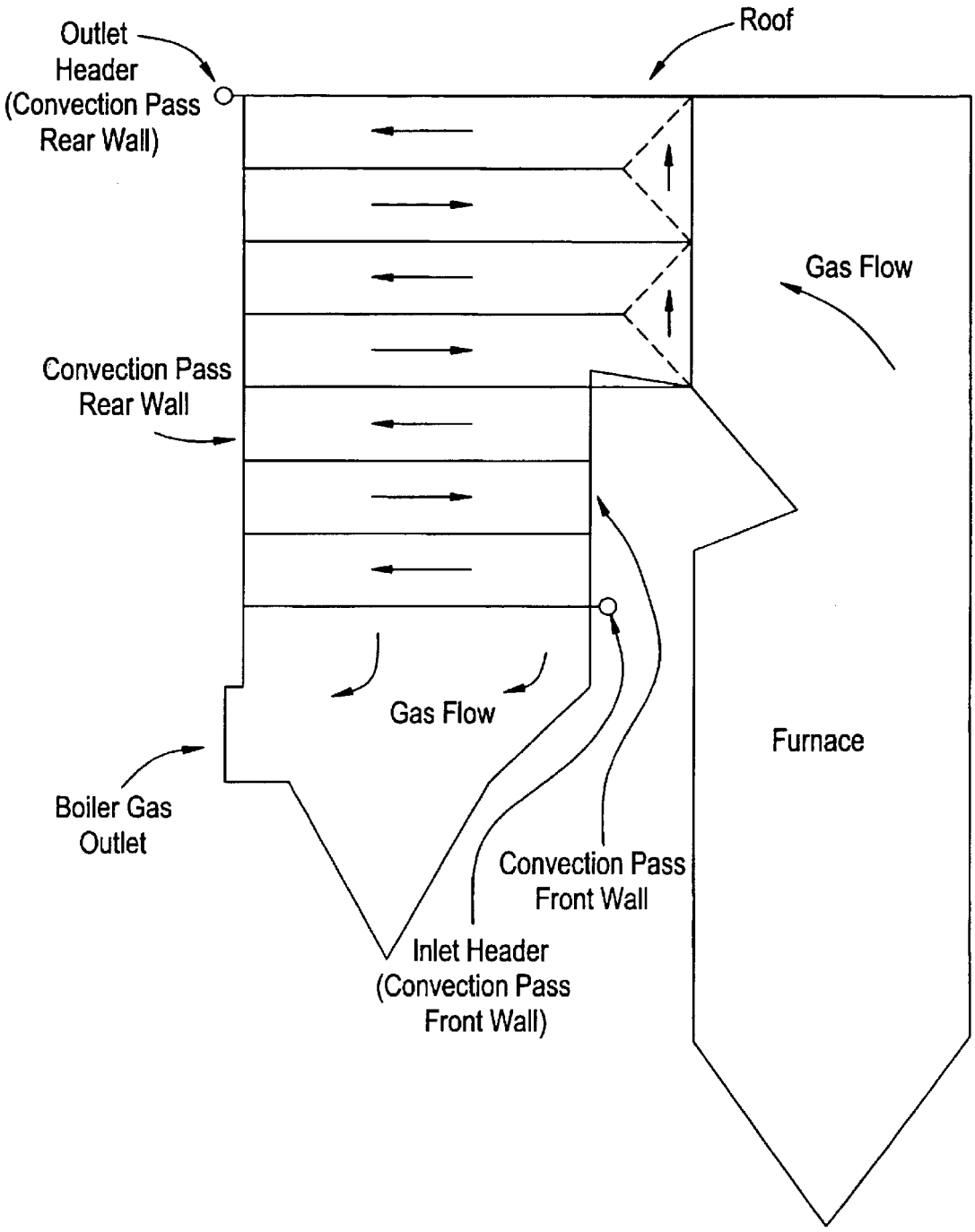
FIG. 12 is an elevational view of the left side wall of the embodiment of FIG. 10.
Figure 13:
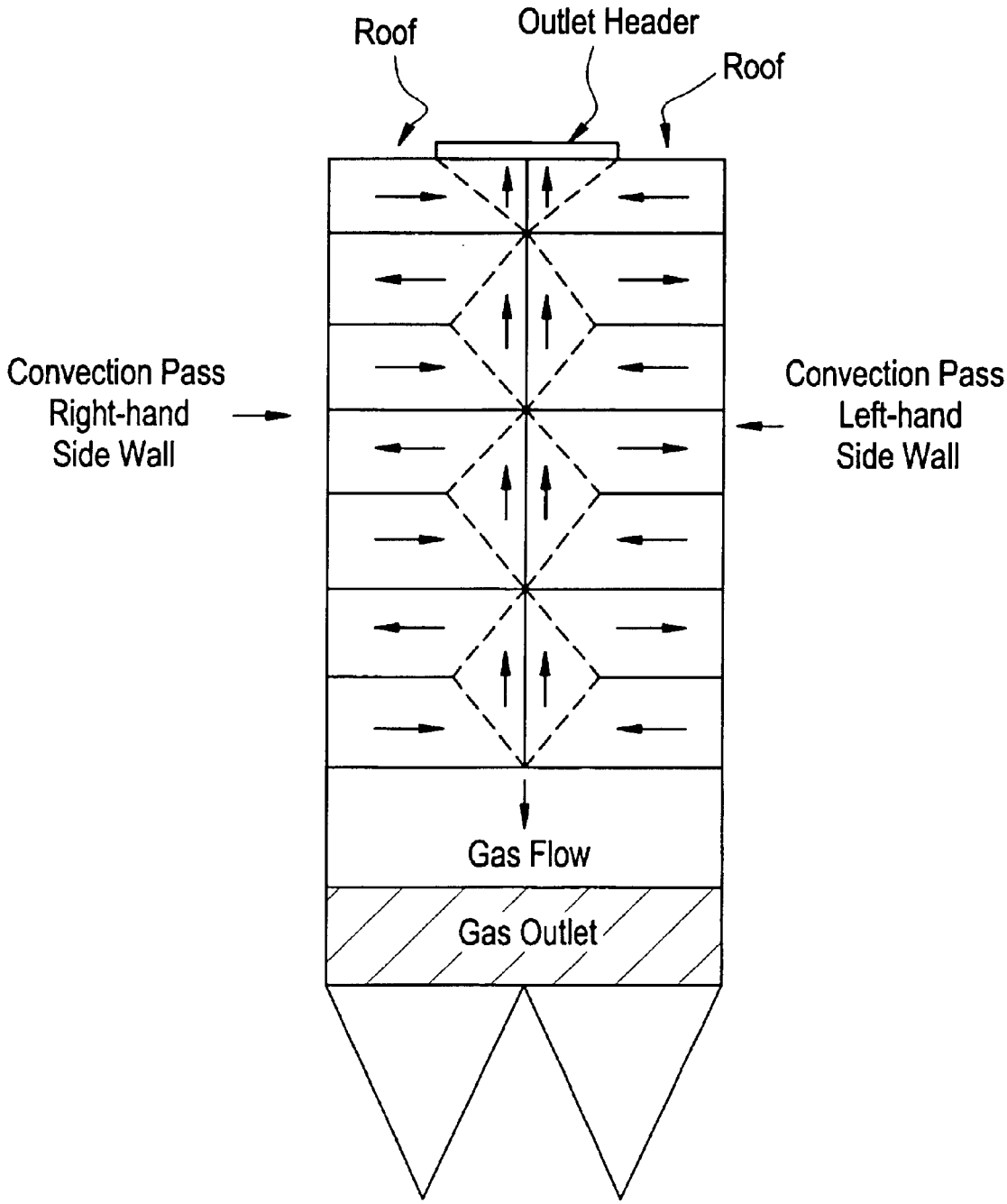
FIG. 13 is an elevational view of the rear wall of the embodiment of FIG. 10.

FIG. 2 illustrates a further embodiment of the invention. Throughout the drawings, the same reference numerals are used to designate the same or functionally similar parts. Inlet header 22 connects the tube assemblies of the horizontal spiral tube arrangement which bend both to begin their horizontal travel across one of the side walls, but also at a corner 42 to extend across the rear wall and then at a further corner 44 to bend around the opposite side wall. In the embodiment of FIG. 2, the inlet header 22 is at the lower end of the convection pass enclosure,whereas the outlet header 40 is at the upper end of the convection pass enclosure and both the inlet and the outlet header are provided on the same side wall and adjacent to the front wall, whereas in the embodiment of FIG. 1 the inlet header is provided on the opposite side wall from the outlet header.

Figure 14:
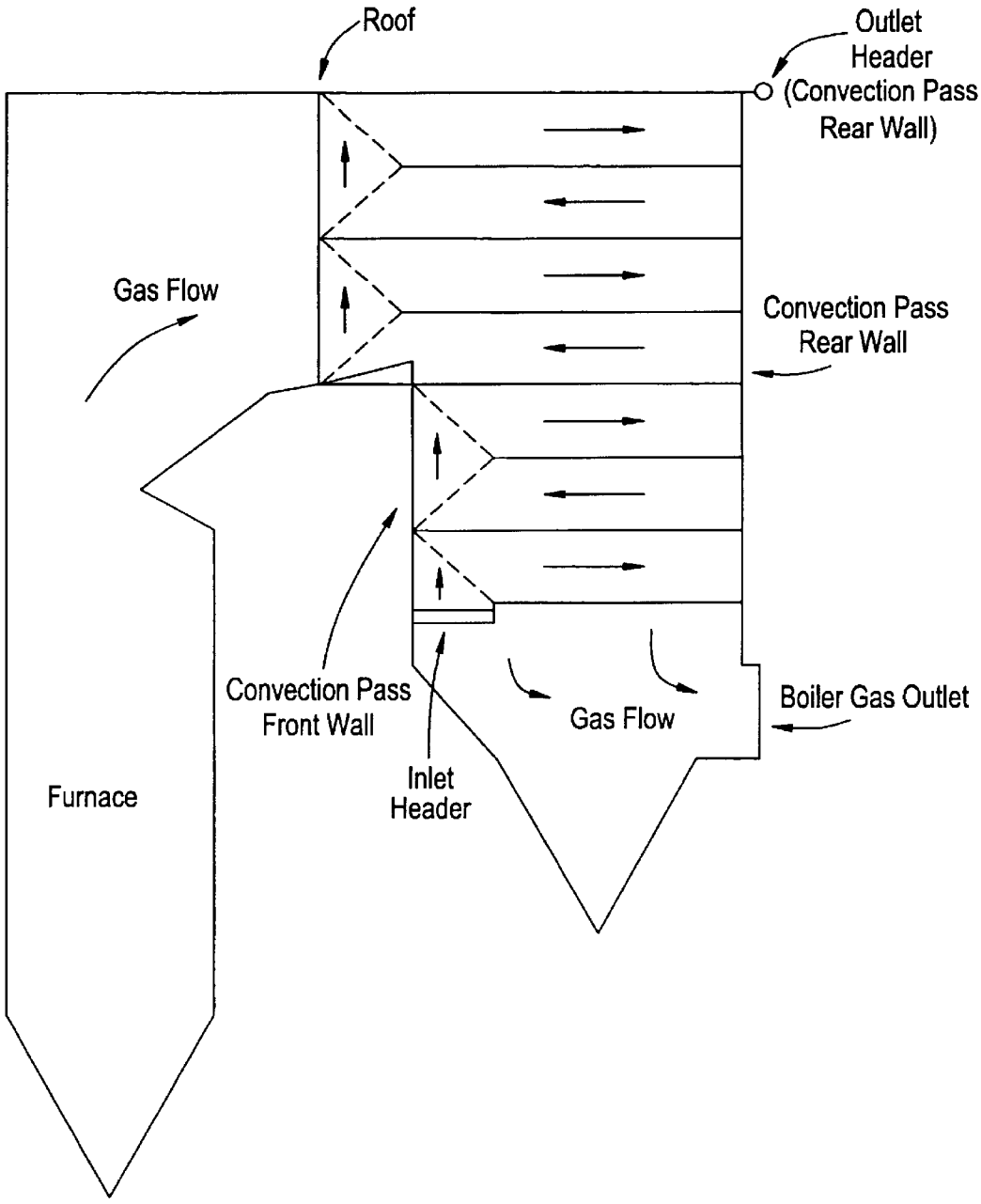
FIG. 14 is an elevational view of the right side wall of still another embodiment of the invention.
Figure 15:
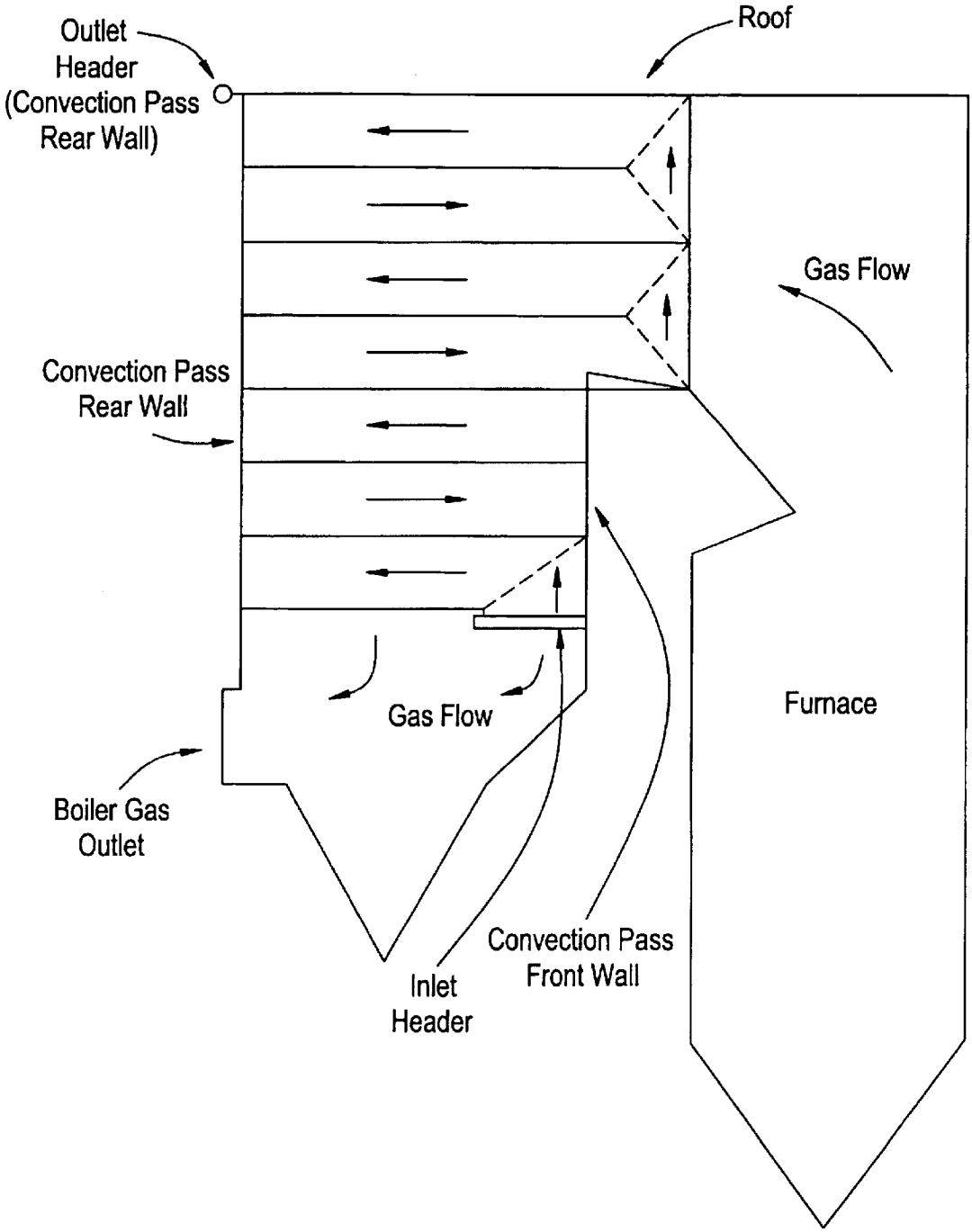
FIG. 15 is an elevational view of the left side wall of the embodiment of FIG. 14.
Figure 16:
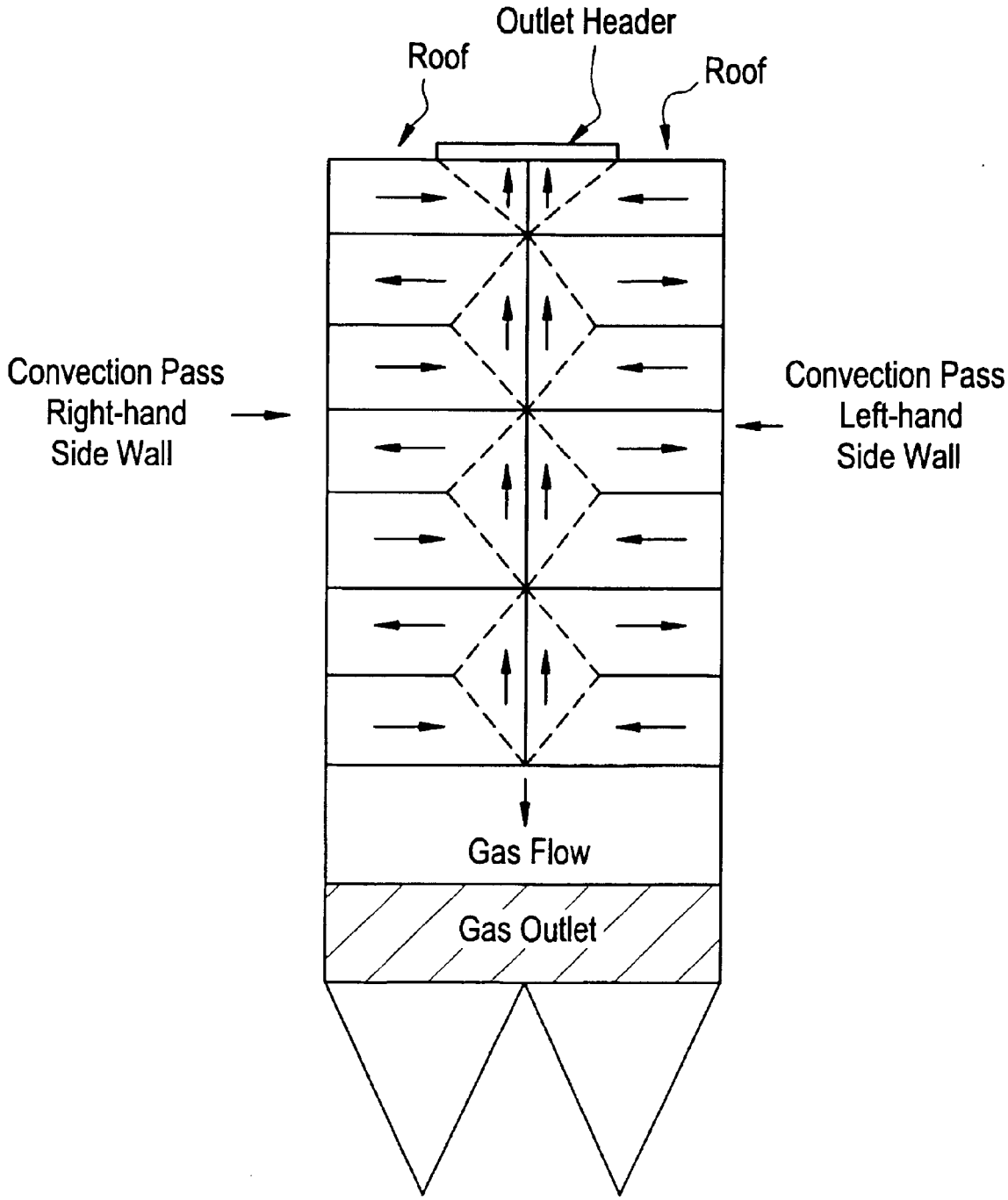
FIG. 16 is an elevational view of the rear wall of the embodiment of FIG. 14.

FIGS. 10, 11, 12 and 13 illustrate another similar embodiment of the invention using a pair of horizontal spiral tube assemblies lining opposite halves of the convection pass enclosure. This is particularly useful where the horizontal spiral tube arrangement includes both the pendant and horizontal convection pass enclosures which uses a common inlet header located at the lower end of the front wall horizontal convection pass enclosure, and a common outlet header located at the upper end of the rear wall to service the pair of horizontal spiral tube assemblies. FIGS. 14, 15, and 16 illustrate another embodiment of the invention having a spiral tube arrangement which includes both the pendant and horizontal convection pass enclosures where one inlet header is provided on the right-hand side wall and another inlet header is provided on the left-hand side wall, both headers being at the lower end of the horizontal convection pass enclosure. A common outlet header is provided at the upper end of the rear wall to service the opposite halves of both convection pass enclosures.

Figure 17:
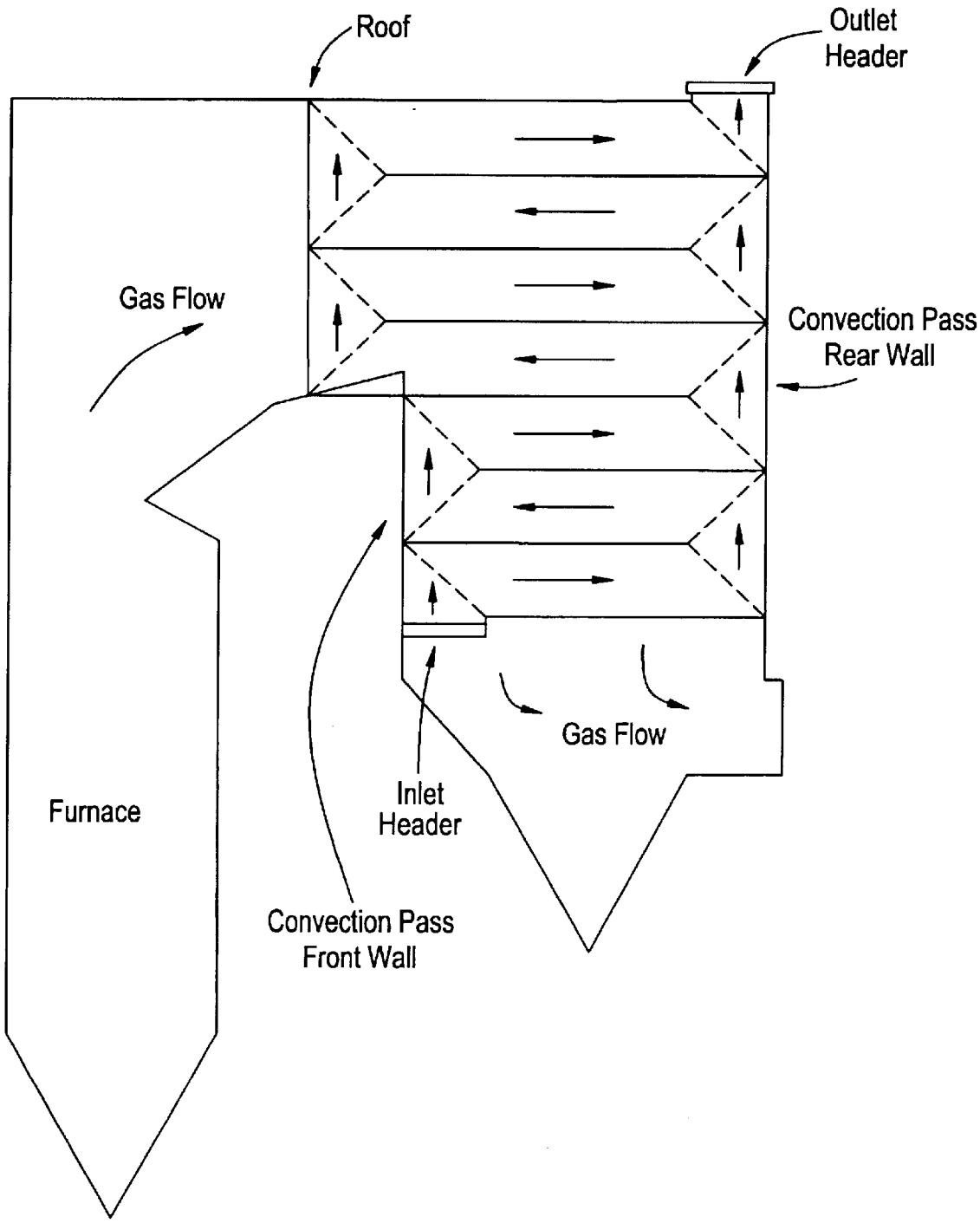
FIG. 17 is an elevational view of the right side wall of still another embodiment of the invention.

FIG. 17 illustrates an embodiment of the invention having a spiral tube arrangement which includes both the pendant and horizontal convection pass enclosures, and depicts the right-hand side wall carrying both the inlet and the outlet header for the horizontal spiral tube assembly, and where the inlet header is adjacent the front wall and the outer header is adjacent the rear wall.

Figure 18:
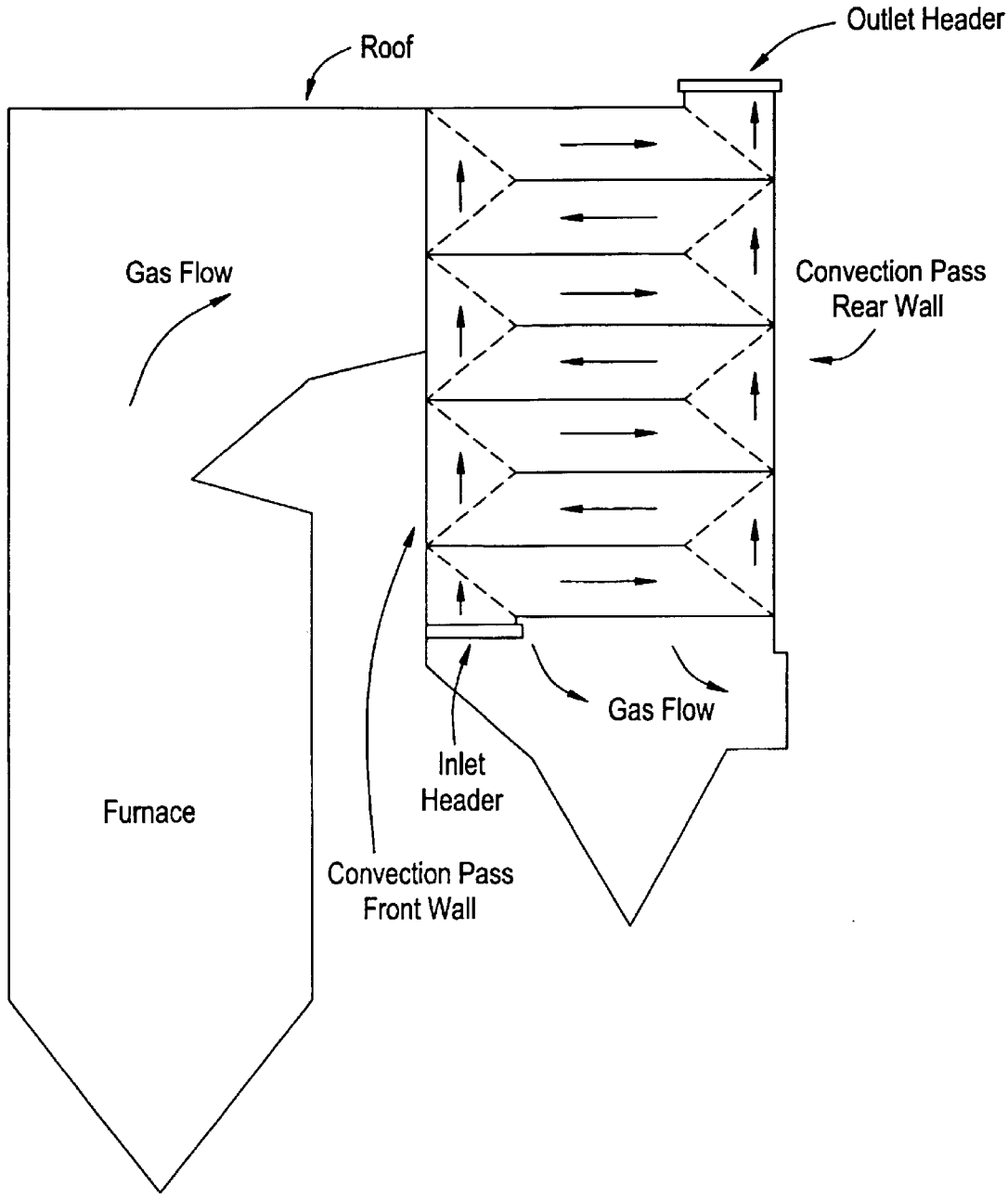
FIG. 18 is an elevational view of the right side wall of a still further embodiment of the invention.

FIG. 18 illustrates an embodiment similar to that shown in FIG. 17, but having a horizontal spiral tube arrangement only for the horizontal convection pass enclosure.

While a specific embodiment of the invention has been shown and described in detail to illustrate the application of the principles of the invention, it will be understood that the invention may be embodied otherwise without departing from such principles.

We claim:

1. A boiler comprising a furnace chamber, a convection pass enclosure located downstream flue gas flow-wise of the furnace chamber, the convection pass enclosure having a heat exchange fluid flow circuitry that includes front, rear and side walls, the front wall having a gas inlet for receiving flue gases from the furnace chamber, the rear wall having a gas outlet for discharging flue gases from the convection pass enclosure, the improvement comprising:

at least one of the front, rear, and side walls being lined with a horizontal spiral tube arrangement;

an inlet header connected to one end of the horizontal spiral tube arrangement for supplying heat exchange fluid thereto; and an outlet header connected to the other end of the horizontal spiral tube arrangement for discharging heat exchange fluid therefrom.

2. The boiler according to claim 1, wherein the inlet and outlet headers are on opposite side walls.

3. The boiler according to claim 1, wherein the inlet and outlet headers are on the same side wall.

4. The boiler according to claim 1, wherein the inlet and outlet headers are adjacent to the front wall.

5. The boiler according to claim 1, wherein the inlet header is adjacent the front wall and the outlet header is adjacent to the rear wall.

6. The boiler according to claim 1, wherein the inlet header is at the lower end of the convection pass enclosure.

7. The boiler according to claim 1, wherein the outlet header is at the upper end of the convection pass enclosure.

8. The boiler according to claim 1, wherein the inlet header is at the front wall.

9. The boiler according to claim 1, wherein the outlet header is at the rear wall.

10. The boiler according to claim 1, wherein the convection pass enclosure includes a pendant section and a horizontal section.

11. The boiler according to claim 10, wherein at least one of the front, rear, and side walls of the horizontal section of the convection pass enclosure is lined with a horizontal spiral tube arrangement.

12. The boiler according to claim 10, wherein at least one of the side walls of the pendant section of the convection pass enclosure is lined with a horizontal spiral tube arrangement.

13. The boiler according to claim 1, wherein both side walls of the convection pass enclosure are lined with horizontal spiral tube arrangements.

14. The boiler according to claim 13, wherein a common inlet header services the horizontal spiral tube arrangements of both side walls.

15. The boiler according to claim 13, wherein a common outlet header services the horizontal spiral tube arrangements of both side walls.

* * * * *